US008651367B1

(12) United States Patent
Spencer

(10) Patent No.: US 8,651,367 B1
(45) **Date of Patent: *Feb. 18, 2014**

(54) COLLECTION CANISTER

(71) Applicant: Wayne Spencer, Tampa, FL (US)

(72) Inventor: Wayne Spencer, Tampa, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/771,649

(22) Filed: Feb. 20, 2013

(51) Int. Cl.
*A47G 29/00* (2006.01)

(52) U.S. Cl.
USPC ..... 232/4 R; 232/1 D; 232/44; 109/66; 362/154

(58) Field of Classification Search
USPC ..... 232/4 R–6, 1 D, 43.1, 19, 44; 220/810, 220/833, 834; 109/59 R, 66; 446/8; 362/154–156, 612, 800, 382
See application file for complete search history.

(56) References Cited

U.S. PATENT DOCUMENTS

| | | | | |
|---|---|---|---|---|
| 471,918 | A | 3/1892 | Van Pelt | |
| 937,503 | A | 10/1909 | Asch | |
| 1,530,908 | A | 3/1925 | Nutry | |
| 2,880,864 | A | 4/1949 | Russo | |
| 2,507,785 | A | 5/1950 | Hartman | |
| 2,754,991 | A | 7/1956 | Hagerty | |
| 3,983,976 | A | 10/1976 | Taylor | |
| 4,079,880 | A * | 3/1978 | Edwards | 220/4.21 |
| 4,671,455 | A | 6/1987 | Stockman | |
| 4,972,304 | A * | 11/1990 | Ylla | 362/156 |
| 4,989,744 | A * | 2/1991 | Tominaga | 220/835 |
| 5,032,957 | A * | 7/1991 | Canfield | 362/133 |
| 5,301,942 | A * | 4/1994 | Lacrosse | 273/138.3 |
| 5,465,909 | A * | 11/1995 | Roth | 232/1 D |
| 5,800,027 | A | 9/1998 | Dunn | |
| 5,947,322 | A | 9/1999 | Ho | |
| 6,540,601 | B2 | 4/2003 | Nottingham | |
| 6,742,294 | B1 | 6/2004 | Fossum | |
| 6,824,291 | B2 * | 11/2004 | Vautrin et al. | 362/156 |
| 6,920,835 | B1 | 7/2005 | Johnson | |
| 7,185,802 | B2 | 3/2007 | Spencer | |
| 7,389,910 | B2 | 6/2008 | Spencer | |
| 7,850,065 | B2 * | 12/2010 | Lederer | 232/44 |
| 8,418,329 | B2 * | 4/2013 | Davis et al. | 27/1 |
| 2009/0127065 | A1 * | 5/2009 | Hacker | 194/215 |

* cited by examiner

*Primary Examiner* — William Miller
(74) *Attorney, Agent, or Firm* — Edward P Dutkiewicz

(57) ABSTRACT

A charitable collection canister comprising, in combination a container having a money recess therein. There is next a lid having an inside surface. The lid is removably coupled to the container. The lid has a money slot, with the money slot having an inwardly and rearwardly oriented tab. The canister has an internal light emitting diode, with a battery electronically coupled thereto. Lastly, there is a window panel, with the window panel being coupled to the inside surface of the lid. The light emitting diode is visible through the window panel.

16 Claims, 7 Drawing Sheets

FIG. 1
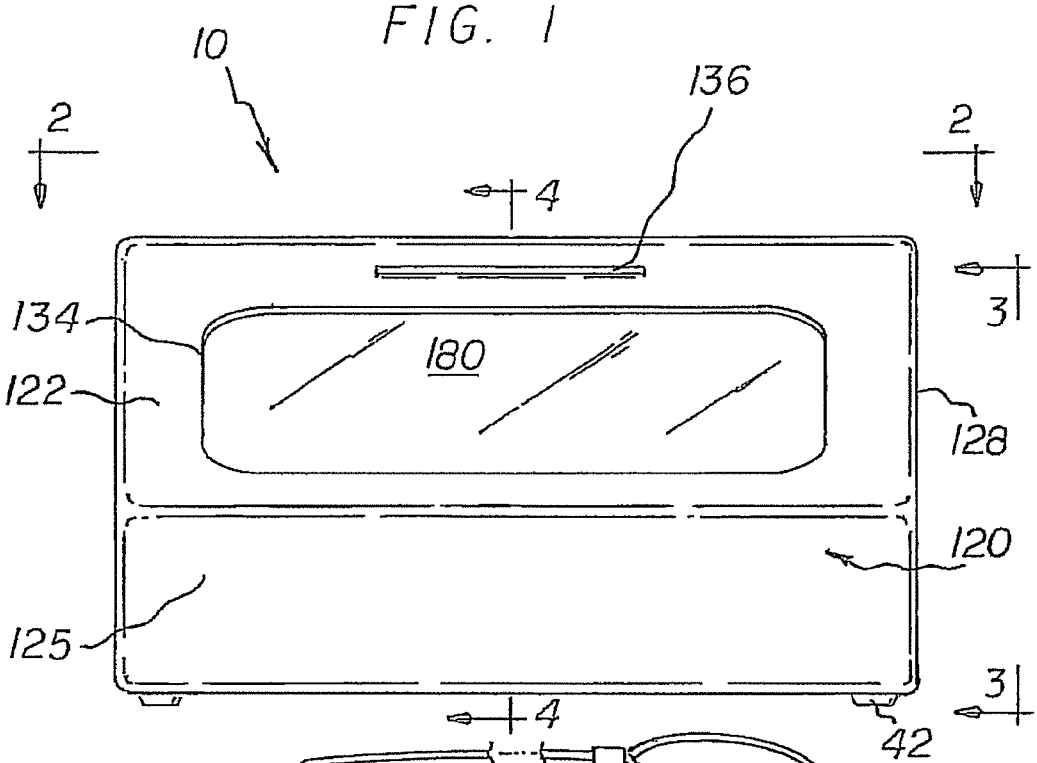
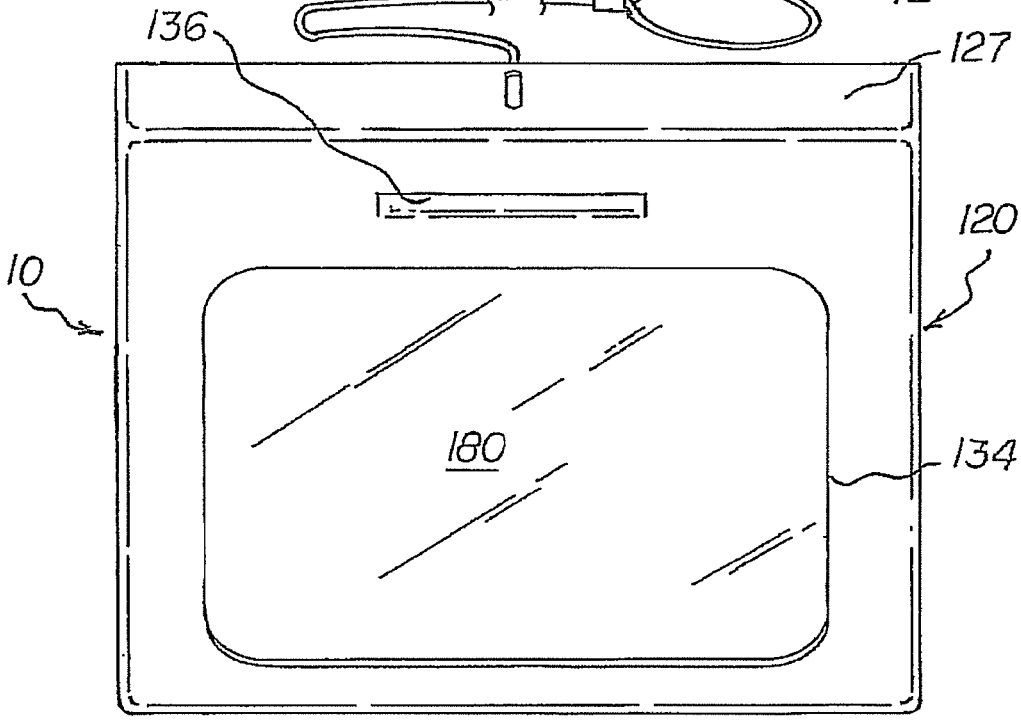
FIG. 2

FIG. 3
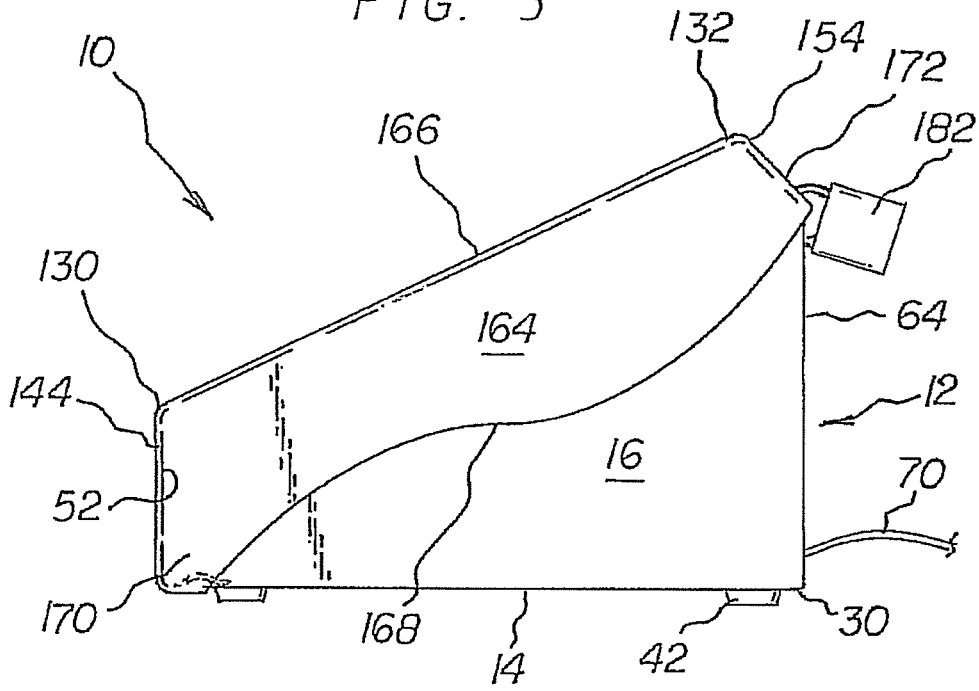
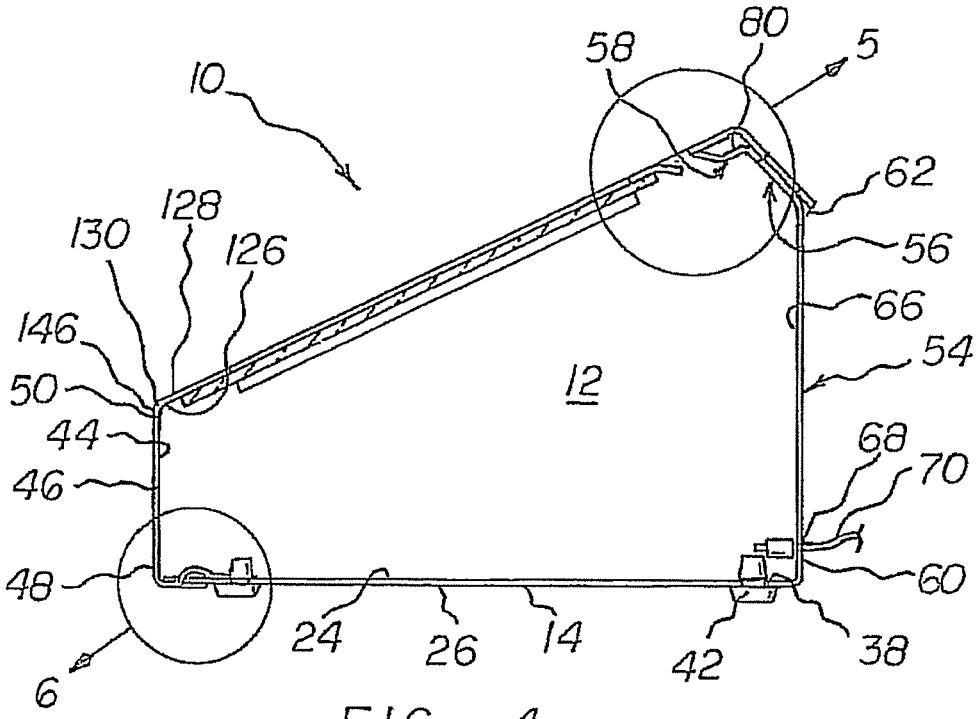
FIG. 4

FIG. 5
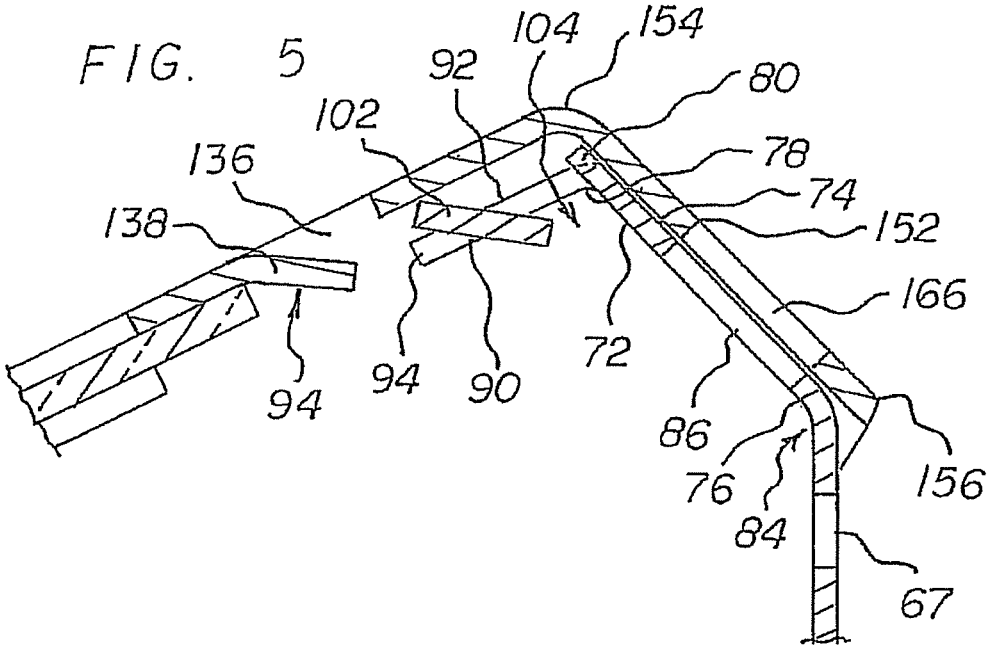
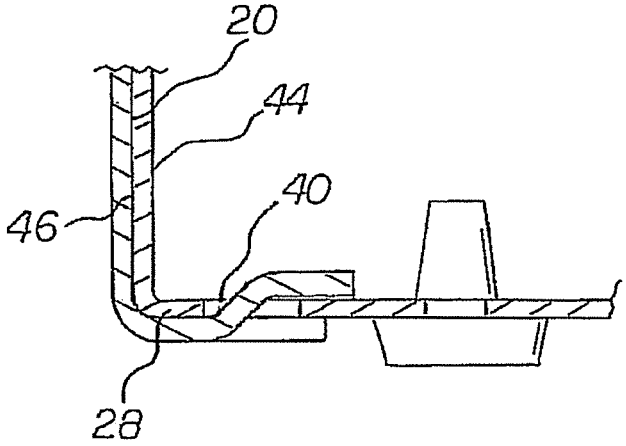
FIG. 6

FIG. 7
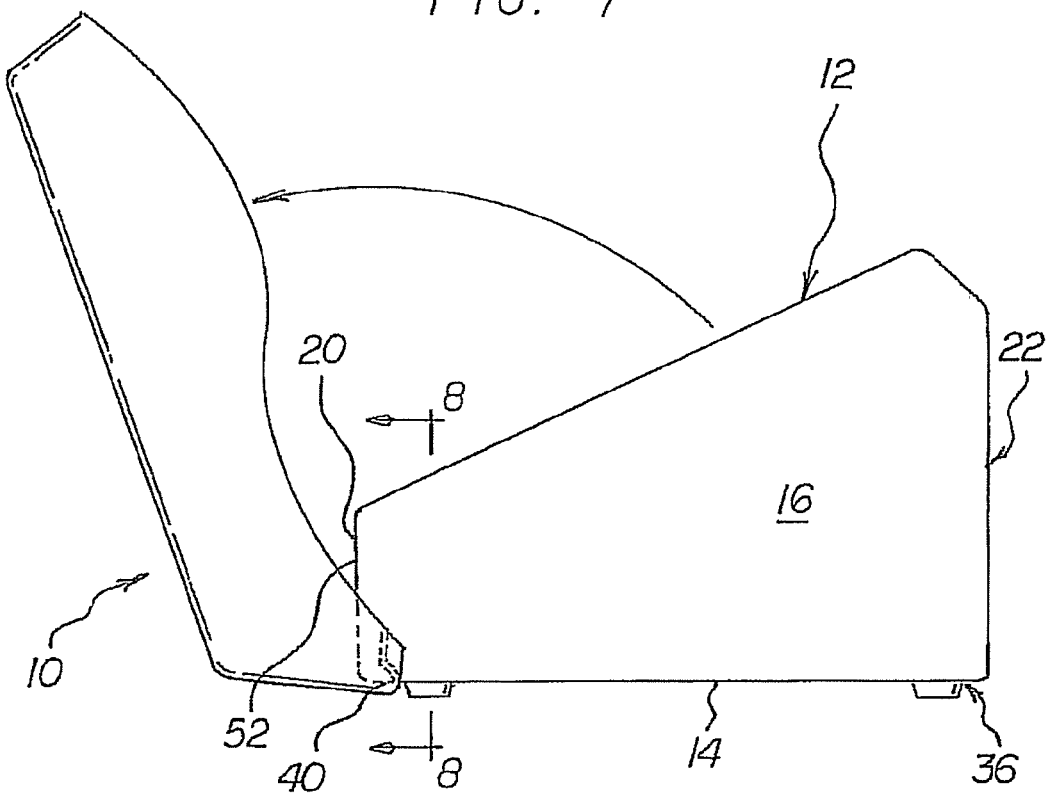
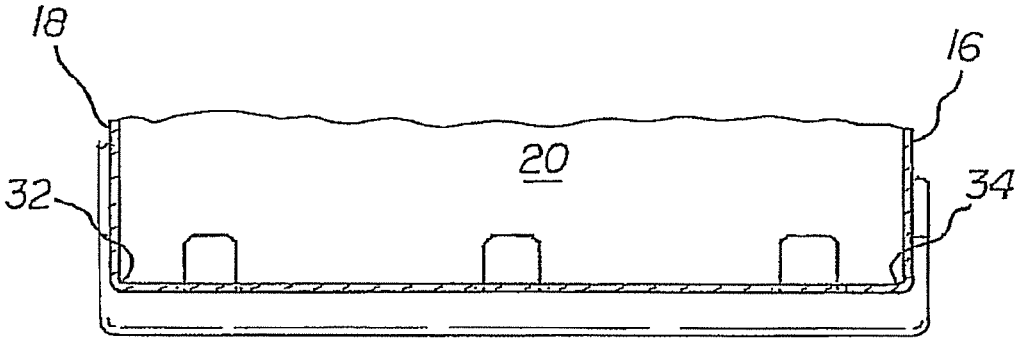
FIG. 8

FIG. 9
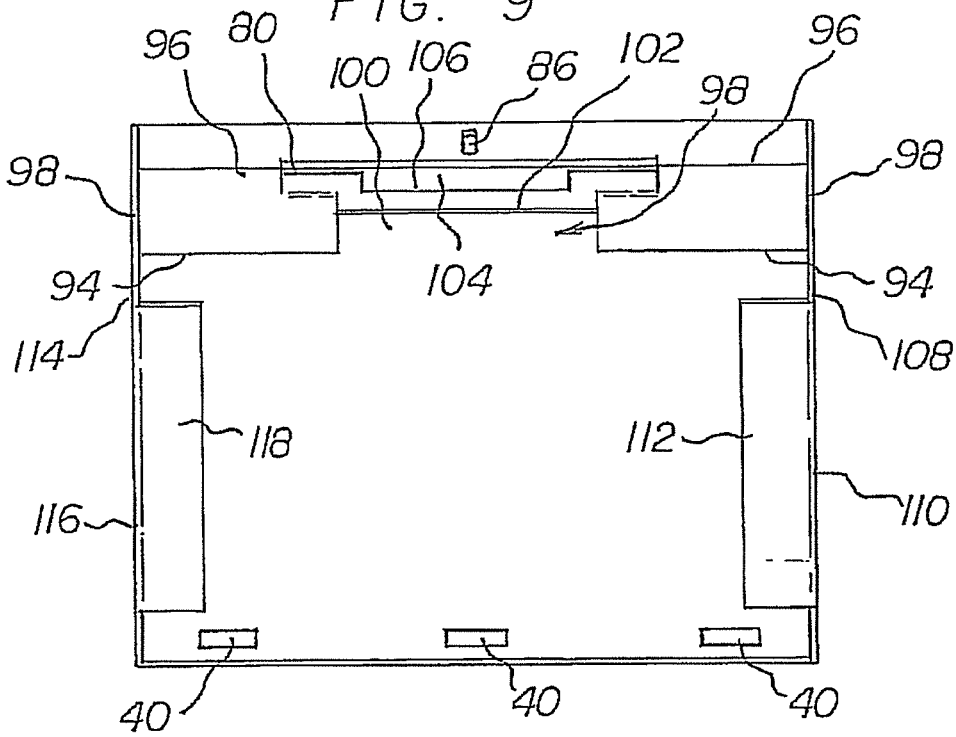
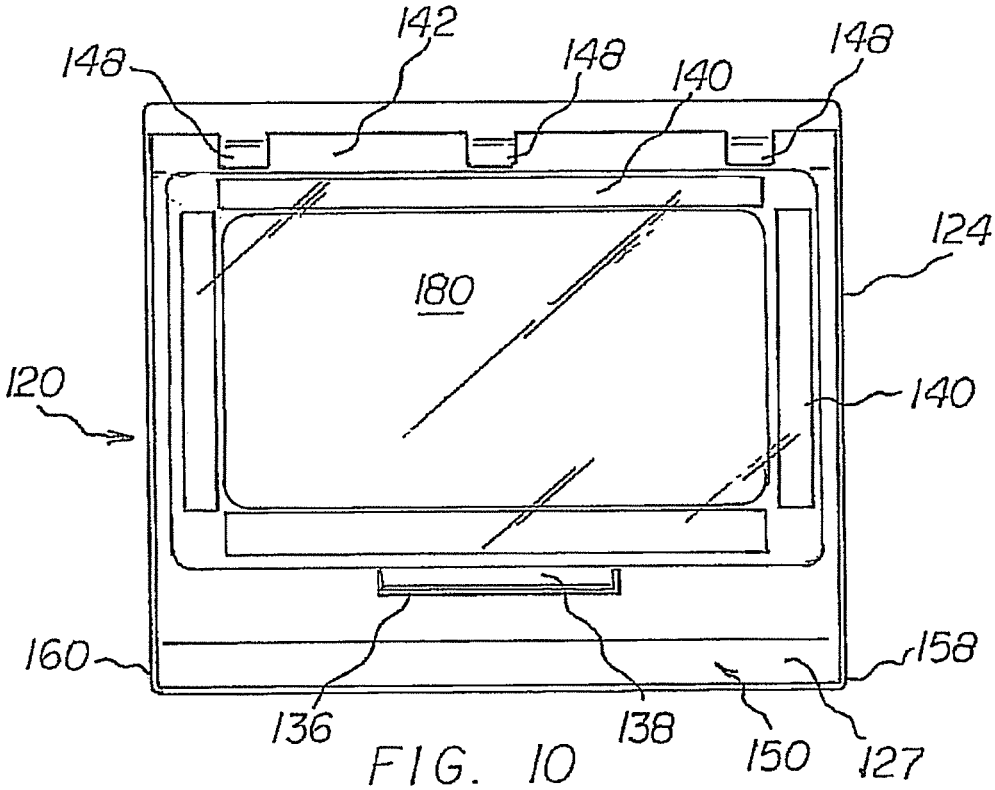
FIG. 10

FIG. 13
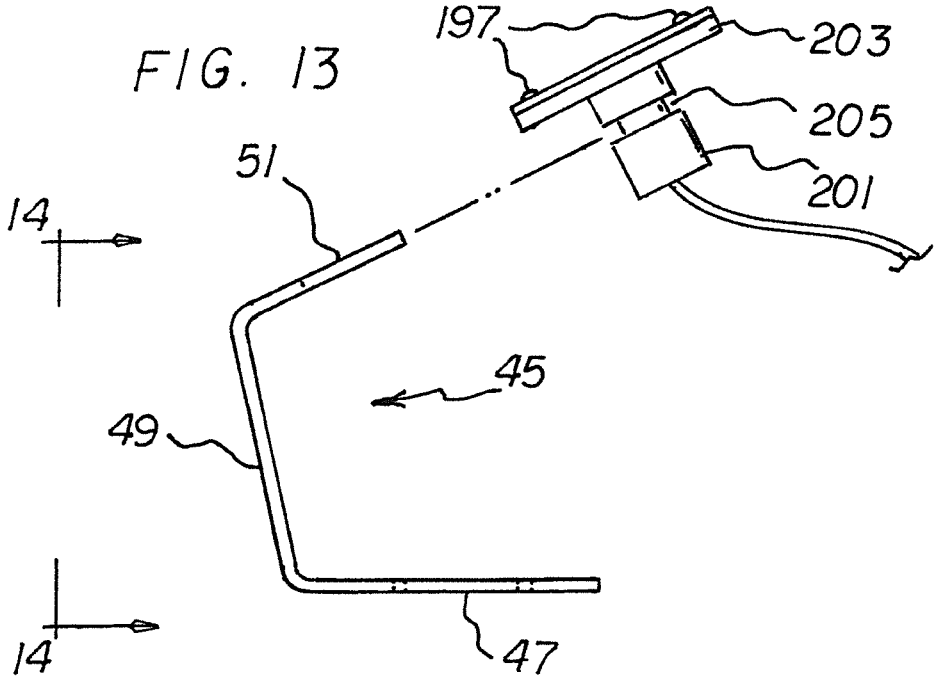
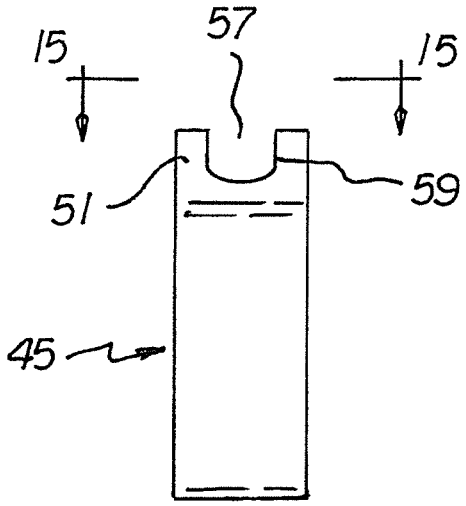
FIG. 14
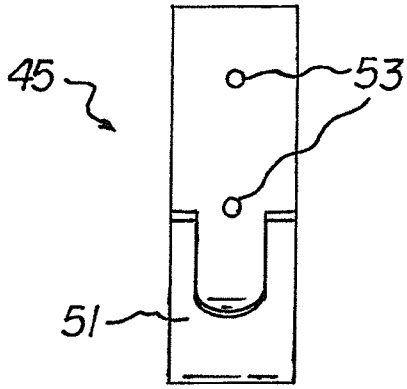
FIG. 15

COLLECTION CANISTER

RELATED PATENT APPLICATIONS

This application is a continuation in part, based upon U.S. Utility patent application Ser. No. 13/422,982 filed Mar. 16, 2012 which is presently pending. This application claims the priority of the parent application, being the Ser. No. 13/422,982 application.

BACKGROUND OF THE INVENTION

Rule 1.78(F) (1) Disclosure

The Applicant has submitted a related pending or patented non-provisional application within two months of the filing date of this present application. The application submitted within the two months of this filing date is a design application, which claims a specific embodiment and configuration of the device broadly claimed in this application. The invention is made by a single inventor, so there are no other inventors to be disclosed. This application is not under assignment to any other person or entity at this time.

FIELD OF THE INVENTION

The present invention relates to a collection canister and more particularly pertains to collection canister which is secure and allows easy cleaning.

DESCRIPTION OF THE PRIOR ART

The use of a canister for collection of contributions is known in the prior art. More specifically, canisters for collecting contributions previously devised and utilized for the purpose of collecting money for charitable causes are known to consist basically of familiar, expected, and obvious structural configurations.

While the prior art devices fulfill their respective, particular objectives and requirements, the prior art does not describe a collection canister that allows for collecting contributions in a canister which is secure, allows for easy cleaning, and is esthetically pleasing.

In this respect, the collection canister according to the present invention, substantially departs from the conventional concepts and designs of the prior art, and in doing so provides an apparatus primarily developed for the purpose of collecting contributions with a canister which is secure and allows for easy cleaning.

Therefore, it can be appreciated that there exists a continuing need for a new and improved collection canister which can be used for collecting contributions in a canister which is secure and allows easy cleaning. In this regard, the present invention substantially fulfills this need.

SUMMARY OF THE INVENTION

In view of the foregoing disadvantages inherent in the known types of canisters for collecting contributions now present in the prior art, the present invention provides an improved collection canister. As such, the general purpose of the present invention, which will be described subsequently in greater detail, is to provide a new and improved collection canister which has all the advantages of the prior art and none of the disadvantages.

To attain this, the present invention essentially comprises a charitable collection canister comprising several components, in combination.

First, there is a container. The container is fabricated of a rigid material. The container has a bottom component and a pair of parallelly located side components being a right side component and a left side component. The container also has a front component and a rear component, with the front component and the rear component being parallelly located. The bottom component, the side components, the front component and the rear component together form an interior of the container.

The bottom component of the container has a generally rectilinear configuration. The bottom component of the container has an inner surface and an outer surface, forming a thickness there between. The bottom component has a horizontal front edge, a horizontal rear edge, and two parallelly located horizontal side edges, being a bottom component right side edge and a bottom component left side edge. The horizontal rear edge intersects with the rearwardmost extent of each of the horizontal bottom component side edges. The horizontal front edge intersects with each of the forwardmost extent of each of the horizontal bottom component side edges. The intersections thereby form the four corners on the bottom component. Each of the four corners of the bottom component have a foot pad aperture therethrough. The four corners generally refer to the area near the intersections of the components and refer to an area rather than a distinct location.

The bottom component of the container has a front portion, with the front portion of the bottom component having three locking slots there through. Each foot pad aperture has an associated foot pad coupled therethrough. There is at least one rivet hole through the bottom component.

The bottom component inner surface has an associated C bracket, which is in the form of a "C". The C bracket has a base, an intermediate portion and a top portion. The base of the C bracket has at least one rivet hole there through, with the rivet hole having an associated rivet coupling the base of the C bracket to the inner surface of the bottom component. The top portion of the C bracket has a generally horseshoe configuration with an recess therein.

The front component of the container has a generally rectilinear configuration. The front component of the container has an inner surface and an outer surface, with a thickness therebetween.

The front component has a horizontal lower edge, a horizontal top edge, and two parallelly located vertical front component side edges, being a front component right vertical side edge and a front component left vertical side edge. The horizontal lower edge of the front surface meets with the horizontal front edge of bottom component.

The rear component of the container has a vertical portion, an angled portion, and an uppermost portion. The vertical portion of the rear component has an inner surface and an outer surface, with a thickness therebetween. The vertical portion of the rear component has a generally rectilinear configuration with a lower horizontal edge, an upper horizontal edge, and a pair of parallelly located vertical side edges, being a right vertical side edge and a left vertical side edge.

The lower horizontal edge of the rear component of the container has a securement cable hole therethrough, with the securement cable hole having an associated securement cable running therethrough. The upper horizontal edge of the vertical portion of the rear component has a centrally located lock hole therethrough.

The angled portion of the rear component of the container has an inner surface and an outer surface, with a thickness there between. The angled portion of the rear component has a generally rectilinear configuration, with a horizontal lower edge, a horizontal upper edge, and a pair of parallelly located side edges.

The horizontal upper edge has an upwardly directed tab extending from the horizontal upper edge of the angled portion of the rear component. The horizontal lower edge of the angled portion of the container is angled relative to the upper horizontal edge of the vertical portion of the rear component. The horizontal lower edge of the angled portion is continuous with the upper horizontal edge of the vertical portion of the rear component. The side edges of the angled portion are located in an intersecting plane with the side edges of the vertical portion of the rear component, thereby forming a side edge angle. The side edge angle is an obtuse angle, relative to the side edges of the vertical portion of the rear component. The angled portion of the rear component has a centrally located locking slot therethrough. The centrally located locking slot is located near to the lock hole of the vertical portion of the rear component.

The uppermost portion of the rear component of the container has an inner surface and an outer surface, with a thickness therebetween. The uppermost portion of the rear component has a generally rectilinear configuration, with a lower horizontal edge, an upper horizontal edge, and a pair of parallelly located uppermost portion side edges.

The lower horizontal edge of the uppermost portion of the rear component of the container has a recess therein. The recess has an outermost extent, with the outermost extent of the recess of the uppermost portion of the rear component having a baffle plate. The baffle plate is oriented at an acute angle relative to the upper surface of the uppermost portion of the rear component. The baffle plate has a generally rectilinear configuration.

The upper horizontal edge of the uppermost portion of the rear component of the container has a money recess therein. The money recess has an innermost extent, with the innermost extent being defined at least in part by the baffle plate.

The right side component of the container has a truncated triangular configuration, having an inner surface, an outer surface, a forward edge, a rearward edge a top edge, and a bottom edge. The forward edge of the right side component and the rearward edge of the right side component are parallelly located. The top edge of the right side component and the bottom edge of the right side component are located in intersecting planes. The bottom edge of the right side component is continuous with the right horizontal side edge of the bottom component. The forward edge of the right side component meets with the front component right vertical side edge. The rearward edge of the right side component is continuous with the right vertical side edge of the vertical portion of the rear component.

The top edge of the right side component of the container has a recess therein, with the recess having a lowermost extent. The lowermost extent of the recess has an leftwardly and inwardly oriented tab. The leftwardly and inwardly oriented tab has a generally rectilinear configuration, with an inner surface and an outer surface, with a thickness therebetween.

The left side component of the container has a truncated triangular configuration having an inner surface, an outer surface, a forward edge, a rearward edge, a top edge, and a bottom edge. The forward edge of the left side component and the rearward edge of the left side component are parallelly located. The top edge of the left side component and the bottom edge of the left side component are located in intersecting planes. The bottom edge of the left side component is continuous with the left horizontal side edge of the bottom component. The forward edge of the left side component meets with the front component left vertical side edge. The rearward edge of the left side component is continuous with the left vertical side edge of the vertical portion of the rear component. The top edge of the left side component has a recess therein, with the recess having a lowermost extent. The lowermost extent of the recess has an rightwardly and inwardly oriented tab. The rightwardly and inwardly oriented tab has a generally rectilinear configuration, with an inner surface and an outer surface, with a thickness therebetween.

Next, there is a lid. The lid is fabricated of a rigid material. The lid has a top component and a pair of parallelly located side components, being a right side component and a left side component. The lid has also has a front component and a rear component, with the front component and the rear component being located on intersecting planes.

The top component of the lid has a generally rectilinear configuration. The top component of the lid has an inner surface and an outer surface, forming a thickness there between. The top component has a horizontal front edge, a horizontal rear edge, and two parallelly located side edges, being a top component right side edge and a top component left side edge.

The top component of the lid has a window opening therethrough. The top component of the lid has a money slot therethrough. The money slot has an inwardly and rearwardly oriented tab. The money slot tab is located so as to be located above the money recess of the upper horizontal edge of the uppermost portion of the rear component.

The window opening of the top component of the lid is located forward of the money slot. The inner surface of the top component of the lid has at least one adhesive strip coupled thereto.

The front component of the lid has a generally rectilinear configuration, with an inner surface, an outer surface, and a thickness therebetween. The front component has a horizontal top edge, which is continuous with the horizontal front edge of the top component.

The front component has a lower edge with an inwardly directed lip. The inwardly directed lip of the front component of the lid has three locking slot tabs. The locking slot tabs are configured to be received by and mated with the locking slots of the front portion of the bottom component. Each of the locking slot tabs have a generally stepped configuration. The front component has a pair of parallelly oriented side edges, being a right edge and a left edge.

The rear component of the lid has a generally rectilinear configuration, with an inner surface and an outer surface, forming a thickness therebetween. The rear component of the lid has a horizontal upper edge, a horizontal lower edge. and two parallelly oriented side edges, being the right side edge and the left side edge. The horizontal upper edge is continuous with the horizontal rear edge of the top component. The rear component of the lid has a lock slot therethrough. The lock slot is located so as to overlay the locking slot of the angled portion of the rear component.

The right side component of the lid has a generally flat configuration, with an inner surface and an outer surface forming a thickness therebetween. The right side component has an upper edge, a lower edge, a forward edge, and a rearward edge. The rearward edge is continuous with the right side edge of the rear component of the lid. The forward edge is continuous with the right side edge of the front component of the lid. The lower edge of the right side component has a generally sinusoidal configuration.

The left side component of the lid has a generally flat configuration, with an inner surface and an outer surface forming a thickness therebetween. The left side component has an upper edge, a lower edge, a forward edge, and a rearward edge. The rearward edge is continuous with the left side edge of the rear component of the lid. The forward edge is continuous with the left side edge of the front component of the lid. The lower edge of the right side component has a generally sinusoidal configuration.

Lastly, there is a window panel. The window panel is fabricated of a transparent material. The window panel is sized to be received between the money slot of the top component and the inner surface of the front component of the lid. The window panel couples with the adhesive strip located on the inner surface of the top component of the lid.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved collection canister which has all of the advantages of the prior art canisters for collecting contributions and none of the disadvantages.

It is another object of the present invention to provide a new and improved collection canister which may be easily and efficiently manufactured and marketed.

It is further object of the present invention to provide a new and improved collection canister which is of durable and reliable constructions.

An even further object of the present invention is to provide a new and improved collection canister which is susceptible of a low cost of manufacture with regard to both materials and labor, and which accordingly is then susceptible of low prices of sale to the consuming public, thereby making such collection canister economically available to the buying public.

Even still another object of the present invention is to provide a collection canister for collecting contributions with a canister which is secure and allows for easy cleaning.

Lastly, it is an object of the present invention to provide a new and improved charitable collection canister comprising, in combination a container having a money recess therein. There is next a lid having an inside surface. The lid is removably coupled to the container. The lid has a money slot, with the money slot having an inwardly and rearwardly oriented tab. Lastly, there is a window panel, with the window panel being coupled to the inside surface of the lid.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is front elevational view of the collection canister.

FIG. 2 is a top plan view of the canister.

FIG. 3 is a right side view of the canister in the closed orientation, showing the lock in position.

FIG. 4 is a view taken along line 4-4 of FIG. 1.

FIG. 5 is a close-up view of circle 5 of FIG. 4.

FIG. 6 is a close-up view of circle 6 of FIG. 4.

FIG. 7 is a right side elevational view with the canister lid being rotated into the open orientation.

FIG. 8 is a view taken along line 8-8 of FIG. 7.

FIG. 9 is a top plan view of the container.

FIG. 10 is a top plan view of the interior of the lid, viewing the inner surface of the lid.

FIG. 13 is an exploded view of the C shaped bracket and light, showing a groove in the light for holding the light in the recess of the C shaped bracket.

FIG. 14 is a view of the C shaped bracket taken along line 14-14 of FIG. 13.

FIG. 15 is a view taken along line 15-1 5 of FIG. 14.

The same reference numerals refer to the same parts throughout the various Figures.

DESCRIPTION OF THE PREFERRED EMBODIMENT

Figure 11:
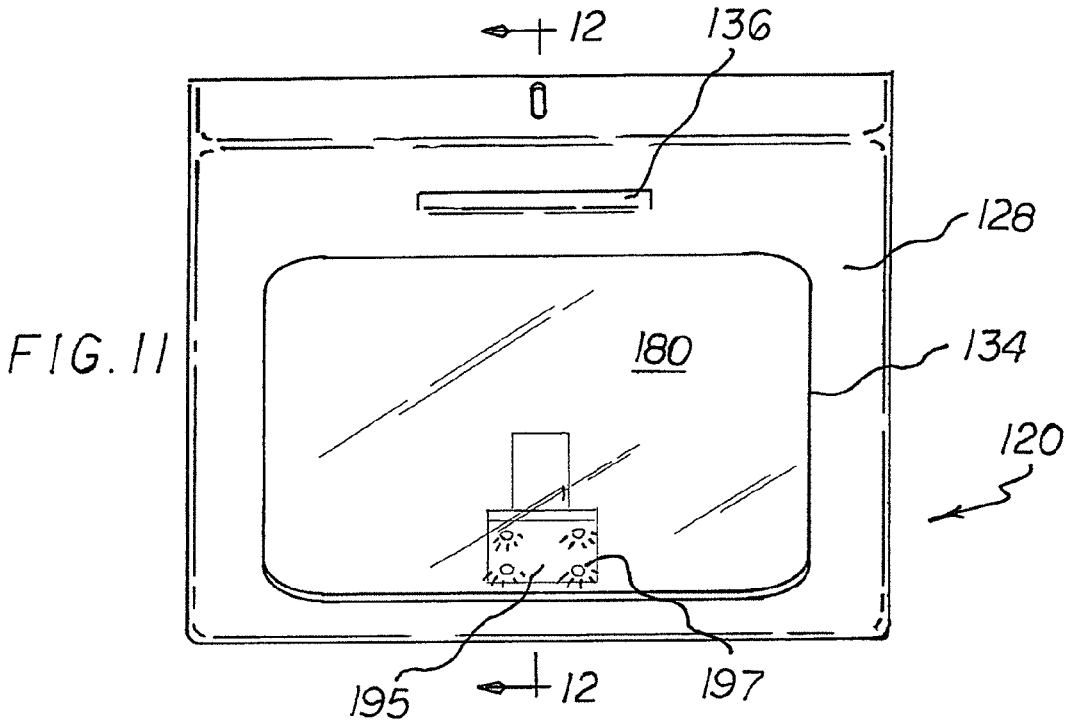
FIG. 11 is a top plan view showing the interior of the canister with the C shaped bracket holding the light emitting diodes near the window panel, so as to have the light emitting diodes visible.
Figure 12:
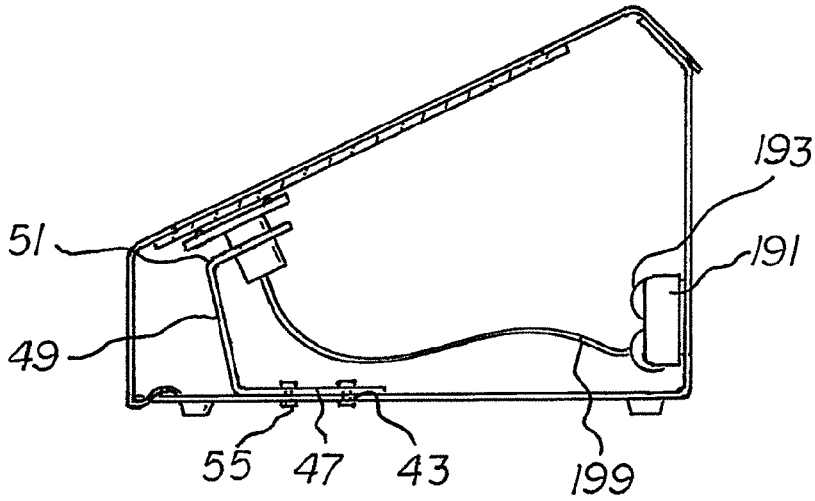
FIG. 12 is a view taken along line 12-12 of FIG. 11, showing the C shaped bracket, bracket rivets, batter and wires electronically coupling the light and the batteries.

With reference now to the drawings, and in particular to FIG. 1 thereof, the preferred embodiment of the new and improved collection canister embodying the principles and concepts of the present invention and generally designated by the reference numeral 10 will be described.

The present invention, the collection canister 10 is comprised of a plurality of components. Such components in their broadest context include a container, a lid, and a transparent panel. Such components are individually configured and correlated with respect to each other so as to attain the desired objective.

First, there is a container 12. The container is fabricated of a rigid material. The container has a bottom component 14 and a pair of parallelly located side components being a right side component 16 and a left side component 18. The container also has a front component 20 and a rear component 22, with the front component and the rear component being parallelly located. The container, generally, has an inner surface.

The bottom component of the container has a generally rectilinear configuration. The bottom component has an inner surface 24 and an outer surface 26, forming a thickness there between. The bottom component has a horizontal front edge 28, a horizontal rear edge 30, and two parallelly located horizontal side edges, being a bottom component right side edge 32 and a bottom component left side edge 34. The horizontal rear edge intersects with the rearwardmost extent of each of the horizontal bottom component side edges. The horizontal front edge intersects with each of the forwardmost extent of each of the horizontal bottom component side edges. The intersections thereby form the four corners 36 on the bottom component. Each of the four corners of the bottom component have a foot pad aperture 38 therethrough.

The bottom component has a front portion, with the front portion of the bottom component having three locking slots 40 there through. Each foot pad aperture has an associated foot pad 42 coupled therethrough. There is at least one rivet hole 43 through the bottom component.

The bottom component inner surface has an associated C bracket 45, which is in the form of a "C". The C bracket has a base 47, an intermediate portion 49 and a top portion 51. The base of the C bracket has at least one rivet hole 53 there through, with the rivet hole having an associated rivet 55 coupling the base of the C bracket to the inner surface of the bottom component. The top portion of the C bracket has a generally horseshoe configuration 57 with an recess 59 therein.

The front component of the container has a generally rectilinear configuration. The front component of the container has an inner surface 44 and an outer surface 46, with a thickness therebetween.

The front component has a horizontal lower edge 48, a horizontal top edge 50, and two parallelly located vertical front component side edges 52, being a front component right vertical side edge and a front component left vertical side edge. The horizontal lower edge of the front surface meets with the horizontal front edge of bottom component.

The rear component of the container has a vertical portion 54, an angled portion 56, and an uppermost portion 58. The vertical portion of the rear component has an inner surface and an outer surface, with a thickness therebetween. The vertical portion of the rear component has a generally rectilinear configuration with a lower horizontal edge 60, an upper horizontal edge 62, and a pair of parallelly located vertical side edges, being a right vertical side edge 64 and a left vertical side edge 66. The vertical portion of the rear component of the container has a lock hole 67 there through.

The lower horizontal edge of the rear component has a securement cable hole 68 therethrough, with the securement cable hole having an associated securement cable 70 running therethrough. The upper horizontal edge of the vertical portion of the rear component has a centrally located lock hole therethrough.

The angled portion of the rear component of the container has an inner surface 72 and an outer surface 74, with a thickness there between. The angled portion of the rear component has a generally rectilinear configuration, with a horizontal lower edge 76, a horizontal upper edge 78, and a pair of parallelly located side edges.

The horizontal upper edge of the angled portion has an upwardly directed tab 80 extending from the horizontal upper edge of the angled portion of the rear component. The horizontal lower edge of the angled portion is angled relative to the upper horizontal edge of the vertical portion of the rear component. The horizontal lower edge of the angled portion is continuous with the upper horizontal edge of the vertical portion of the rear component. The side edges of the angled portion are located in an intersecting plane with the side edges of the vertical portion of the rear component, thereby forming a side edge angle 84. The side edge angle is an obtuse angle, relative to the side edges of the vertical portion of the rear component. The angled portion of the rear component has a centrally located locking slot 86 therethrough. The centrally located locking slot is located near to the lock hole of the vertical portion of the rear component.

The uppermost portion of the rear component has an inner surface 90 and an outer surface 92, with a thickness therebetween. The uppermost portion of the rear component has a generally rectilinear configuration, with a lower horizontal edge 94, an upper horizontal edge 96, and a pair of parallelly located uppermost portion side edges 98.

The lower horizontal edge of the uppermost portion of the rear component has a recess 98 therein. The recess has an outermost extent, with the outermost extent 100 of the recess of the uppermost portion of the rear component having a baffle plate 102. The baffle plate is oriented at an acute angle relative to the upper surface of the uppermost portion of the rear component. The baffle plate has a generally rectilinear configuration.

The upper horizontal edge of the uppermost portion of the rear component has a money recess 104 therein. The money recess has an innermost extent 106, with the innermost extent being defined at least in part by the baffle plate.

The right side component of the container has a truncated triangular configuration, having an inner surface, an outer surface, a forward edge, a rearward edge a top edge 108, and a bottom edge. The forward edge of the right side component and the rearward edge of the right side component are parallelly located. The top edge of the right side component and the bottom edge of the right side component are located in intersecting planes. The bottom edge of the right side component is continuous with the right horizontal side edge of the bottom component. The forward edge of the right side component meets with the front component right vertical side edge. The rearward edge of the right side component is continuous with the right vertical side edge of the vertical portion of the rear component.

The top edge of the right side component has a recess 110 therein, with the recess having a lowermost extent. The lowermost extent of the recess has an leftwardly and inwardly oriented tab 112. The leftwardly and inwardly oriented tab has a generally rectilinear configuration, with an inner surface and an outer surface, with a thickness therebetween.

The left side component of the container has a truncated triangular configuration having an inner surface, an outer surface, a forward edge, a rearward edge, a top edge 114, and a bottom edge. The forward edge of the left side component and the rearward edge of the left side component are parallelly located. The top edge of the left side component and the bottom edge of the left side component are located in intersecting planes. The bottom edge of the left side component is continuous with the left horizontal side edge of the bottom component. The forward edge of the left side component meets with the front component left vertical side edge. The rearward edge of the left side component is continuous with the left vertical side edge of the vertical portion of the rear component. The top edge of the left side component has a recess 116 therein, with the recess having a lowermost extent. The lowermost extent of the recess has an rightwardly and inwardly oriented tab 118. The rightwardly and inwardly oriented tab has a generally rectilinear configuration, with an inner surface and an outer surface, with a thickness therebetween.

Next, there is a lid 120. The lid is fabricated of a rigid material. The lid has a top component 122 and a pair of parallelly located side component 124, being a right side component and a left side component. The lid has also has a front component 125 and a rear component 127, with the front component and the rear component being located on intersecting planes.

The top component of the lid has a generally rectilinear configuration. The top component of the lid has an inner surface 126 and an outer surface 128, forming a thickness there between. The top component has a horizontal front edge 130, a horizontal rear edge 132, and two parallelly located side edges, being a top component right side edge and a top component left side edge.

The top component of the lid has a window opening 134 therethrough. The top component of the lid has a money slot 136 therethrough. The money slot has an inwardly and rearwardly oriented tab 138. The money slot tab is located so as to be located above the money recess of the upper horizontal edge of the uppermost portion of the rear component.

The window opening of the top component of the lid is located forward of the money slot. The inner surface of the top component of the lid has at least one adhesive strip 140 coupled thereto.

The front component of the lid has a generally rectilinear configuration, with an inner surface 142, an outer surface 144, and a thickness therebetween. The front component has a horizontal top edge 146, which is continuous with the horizontal front edge of the top component.

The front component has a lower edge with an inwardly directed lip. The inwardly directed lip of the front component of the lid has three locking slot tabs 148. The locking slot tabs are configured to be received by and mated with the locking slots of the front portion of the bottom component. Each of the locking slot tabs have a generally stepped configuration. The front component has a pair of parallelly oriented side edges, being a right edge and a left edge.

The rear component of the lid has a generally rectilinear configuration, with an inner surface 150 and an outer surface 152, forming a thickness therebetween. The rear component of the lid has a horizontal upper edge 154, a horizontal lower edge 156. and two parallelly oriented side edges, being the right side edge 158 and the left side edge 160. The horizontal upper edge is continuous with the horizontal rear edge of the top component. The rear component of the lid has a lock slot 162 therethrough. The lock slot is located so as to overlay the locking slot of the angled portion of the rear component.

The right side component of the lid 164 has a generally flat configuration, with an inner surface and an outer surface forming a thickness therebetween. The right side component has an upper edge 166, a lower edge 168, a forward edge 170, and a rearward edge 172. The rearward edge is continuous with the right side edge of the rear component of the lid. The forward edge is continuous with the right side edge of the front component of the lid. The lower edge of the right side component has a generally sinusoidal configuration.

The left side component of the lid has a generally flat configuration, with an inner surface and an outer surface forming a thickness therebetween. The left side component has an upper edge, a lower edge, a forward edge, and a rearward edge. The rearward edge is continuous with the left side edge of the rear component of the lid. The forward edge is continuous with the left side edge of the front component of the lid. The lower edge of the right side component has a generally sinusoidal configuration.

Next, there is a window panel 180. The window panel is fabricated of a transparent material. The window panel is sized to be received between the money slot of the top component and the inner surface of the front component of the lid. The window panel couples with the adhesive strip located on the inner surface of the top component of the lid.

In the preferred embodiment the window panel is used to allow the general public to view the contents of the container. In other embodiments, however, the window panel may either be replaced with a translucent or opaque panel, or the panel may be omitted all together, with the top component of the lid being solid, with a window opening.

A lock 182 is provided to secure the canister in a closed position.

Lastly, there is a battery holder 191, at least one associated battery 193, a light shape 195 comprising a light emitting diode 197 and pair of wires 199 electronically connecting the battery with the light emitting diode. The battery holder is one which is commonly used, and well known to those skilled in the art. The battery holder has two pairs of contacts, with each pair of contacts wired in series. In other embodiments there may be one battery with only a pair of contacts. In still another embodiment, the battery contacts may be wired in parallel. The light has a mounting portion 201 and an illuminating portion 203. In the preferred embodiment the light comprises at least one light emitting diode 197. The diode may be intermittently illuminated as is the case in the preferred embodiment, or the diode may be continuously illuminated. In the preferred embodiment, the light mounting portion has a mounting groove 205 therein. The mounting groove engages and mates with the recess of the C shaped bracket.

The light shape may be a particular shape, or may amorphous. By particular shape is meant that the light may be part of a logo, or an entire logo, which is recognized by some of the public. The light emitting diodes are incorporated into the light shape so as to attract attention to the light shape.

The mounting portion of the light is received and mated with the recess of the top portion of the C bracket. The light is held in a position so as to display the lighted light emitting diode through the transparent window panel. The unexpected result of placing the light emitting diode to be visible in the window panel is that the amount of donations made to the lighted collection canister is greater than an unlighted canister. This has been demonstrated in a side by side comparison between lighted canisters and unlighted canisters in the same location, with the canisters with the light emitting diodes being visible having an increase in contributions of about forth percent more than the unlighted canisters.

Functionally, the canister hinges about the locking slot tabs. The lid rotates and then contains the rear portion of the container. A lock is passed through the locking slot of the lid and the locking slot of the angled portion of the rear component, and then through the lock hole of the rear portion of the container, so that the lid is secured in place.

Another advantage of the canister is the baffle which prevents money being poured from the container with the container inverted and rolled. The baffle tends to trap money between the baffle and the angled portion of the rear component of the container. The baffle makes it difficult for an unauthorized person to remove money from the collection container by inverting and rolling the canister, while closed.

The container and lid may be made of steel, such as stainless steel, or aluminum. The lid may be made of stainless steal and the container made of aluminum. In other variations, the entire canister may be made of either stainless steel or aluminum.

The window panel is held in place by the adhesive strips. However, once closed, the lid presses the window panel against the tabs of the side components of the container. The width of the window, as well as the positioning between the money slot and the front edge of the inner surface of the lid, prevents the window panel from being moved aside, to permit unauthorized removal of money from the canister, when the lid is in the closed orientation.

The rubber, or skid resistant material used for the foot pads keeps the container from sliding. Also, the spacing between the outer surface of the bottom of the container and the surface upon which the container is resting allows for air to move beneath the container, allowing for drying of any moisture which may accumulate beneath the container when in place.

The clam shell-like opening of the container and lid allows for easy cleaning of the interior of the canister. Present embodiments of other collection canisters have a slide-in collection container, which does not allow for easy cleaning. The canister may be made in a number of proportions between the overall length of the canister, when assembled, and the overall width of the canister, when assembled. The primary embodiment is presented as a visually appealing, compact, unit, which is readily placeable, and securable, on a countertop.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A charitable collection canister comprising, in combination:

a container having a bottom component and a pair of side components being a right side component and a left side component, and a front component and a rear component, the rear component having an uppermost portion with the uppermost portion having an upper horizontal edge, the upper horizontal edge having a money recess therein, the bottom component having an inner surface and an outer surface forming a thickness there between, the bottom component having four corners;

a lid having a top component and a pair of side components being a right side component and a left side component, and a front component and a rear component, the lid being removably coupled to the container, the top component of the lid having a money slot, with the money slot having an inwardly and rearwardly oriented tab;

a window panel, the window panel being coupled to the top component of the lid;

at least one battery electronically coupled by a pair of wires to at least one light emitting diode; and a C bracket coupling the light emitting diode to the inner surface of the bottom component.

2. The charitable collection canister as described in claim 1, with the canister further comprising;

the bottom component of the container having a front portion with the front portion of the bottom component having three locking slots there through;

the front component of the container having an inner surface and an outer surface with a thickness therebetween;

the right side component of the container having an inner surface and an outer surface and a forward edge and a rearward edge and a top edge and a bottom edge;

the rear component having an angled portion of the container having a centrally located locking slot therethrough, the left side component of the container having an inner surface and an outer surface and a forward edge and a rearward edge and a top edge and a bottom edge;

the top component of the lid having an inner surface and an outer surface forming a thickness there between, the top component of the lid having a horizontal front edge and a horizontal rear edge and two side edges being a top component right side edge and a top component left side edge, the top component of the lid having a window aperture therethrough;

the window panel being sized to be received between the money slot of the top component of the lid and the inner surface of the front component of the lid with the window panel being sized to be larger than the window aperture of the top component of the lid;

the front component of the lid having an inner surface and an outer surface with a thickness therebetween, the front component having a horizontal top edge which is continuous with the horizontal front edge of the top component, the front component having a lower edge with an inwardly directed lip;

the light emitting diode being incorporated into a light shape; and the rear component of the lid having an inner surface and an outer surface with a thickness therebetween, the rear component of the lid having a horizontal upper edge and a horizontal lower edge and two side edges being the right side edge and the left side edge, the horizontal upper edge of the rear component of the lid being continuous with the horizontal rear edge of the top component of the lid, the rear component of the lid has a lock slot therethrough, with the lock slot being located so as to overlay the locking slot of the angled portion of the rear component of the container.

3. The charitable collection canister as described in claim 2, with the canister further comprising;

the top edge of the right side component of the container and the bottom edge of the right side component of the container being located in intersecting planes;

the top edge of the left side component of the container and the bottom edge of the left side component of the container being located in intersecting planes;

the rear component of the container having a vertical portion with an inner surface and an outer surface with a thickness there between, and an angled portion with an inner surface and an outer surface with a thickness there between, and an uppermost portion with an inner surface and an outer surface with a thickness there between;

the uppermost portion of the rear component of the container having a lower horizontal edge and an upper horizontal edge and a pair of parallelly located uppermost portion side edges, the lower horizontal edge of the uppermost portion of the rear component having a recess therein, the recess having an rearwardmost extent with the rearwardmost extent of the recess of the uppermost portion of the rear component having a baffle plate, with the baffle plate being oriented at an acute angle relative to the upper surface of the uppermost portion of the rear component, the baffle plate having a generally rectilinear configuration, the upper horizontal edge of the uppermost portion of the rear component having a money recess therein with the money recess having an forwardmost extent with the forwardmost extent being defined in part by the baffle plate;

the money slot tab of the top component of the lid being located so as to be located above the money recess of the upper horizontal edge of the uppermost portion of the rear component;

the top component of the lid having a window opening therethrough, the money slot tab being located so as to be located above the money recess of the upper horizontal edge of the uppermost portion of the rear component, with the window opening being located forward of the money slot;

the right side component of the lid having an inner surface and an outer surface with a thickness therebetween, the right side component having an upper edge and a lower edge and a forward edge and a rearward edge;

the light emitting diode being illuminated intermittently; and the left side component of the lid having an inner surface and an outer surface with a thickness therebetween, the left side component having an upper edge and a lower edge and a forward edge and a rearward edge.

4. The charitable collection canister as described in claim 3, with the canister further comprising;

the bottom component of the container having a horizontal front edge and a horizontal rear edge and two parallelly located horizontal side edges being a bottom component right side edge and a bottom component left side edge;

the vertical portion of the rear component of the container having an upper horizontal edge having a centrally located lock hole therethrough;

the centrally located locking slot of the angled portion of the rear component of the container being near to the lock hole of the vertical portion of the rear component;

the bottom edge of the right side component of the container being continuous with the right horizontal side edge of the bottom component of the container;

the bottom edge of the left side component of the container being continuous with the left horizontal side edge of the bottom component of the container;

the lowermost extent of the top edge of the left side component of the container having a recess therein with the recess having a lowermost extent, the lowermost extent of the recess having an rightwardly and inwardly oriented tab, with the rightwardly and inwardly oriented tab having a generally rectilinear configuration with an inner surface and an outer surface and a thickness therebetween;

the lowermost extent of the top edge of the right side component of the container having a recess therein with the recess having a lowermost extent, the lowermost extent of the recess having an leftwardly and inwardly oriented tab, with the leftwardly and inwardly oriented tab having a generally rectilinear configuration with an inner surface and an outer surface and a thickness therebetween;

the top edge of the left side component of the container and the bottom edge of the left side component of the container being located in intersecting planes, the bottom edge of the left side component being continuous with the left horizontal side edge of the bottom component;

the top edge of the right side component of the container and the bottom edge of the right side component of the container being located in intersecting planes, the bottom edge of the right side component being continuous with the right horizontal side edge of the bottom component;

the forward edge of the left side component of the container meeting with the front component left vertical side edge of the container, the rearward edge of the left side component of the container being continuous with the left vertical side edge of the vertical portion of the rear component of the container;

the forward edge of the right side component of the container meeting with the front component right vertical side edge of the container, the rearward edge of the right side component of the container being continuous with the right vertical side edge of the vertical portion of the rear component of the container;

the angle portion of the rear component of the container having a horizontal lower edge and a horizontal upper edge and side edges;

the right side component of the lid rearward edge being continuous with the right side edge of the rear component of the lid, the forward edge being continuous with the right side edge of the front component of the lid, the lower edge of the right side component having a generally sinusoidal configuration; and the left side component of the lid rearward edge being continuous with the left side edge of the rear component of the lid, the forward edge being continuous with the left side edge of the front component of the lid, the lower edge of the right side component having a generally sinusoidal configuration.

5. The charitable collection canister as described in claim 4, with the canister further comprising;

the four corners of the bottom component of the container each having a foot pad aperture therethrough;

the forward edge of the right side component of the container and the rearward edge of the right side component of the container being parallelly located with the forward edge of the right side component of the container meeting with the front component right vertical side edge, the rearward edge of the right side component of the container being continuous with the right vertical side edge of the vertical portion of the rear component;

the forward edge of the left side component of the container and the rearward edge of the left side component of the container being parallelly located with the forward edge of the left side component of the container meeting with the front component left vertical side edge, the rearward edge of the left side component of the container being continuous with the left vertical side edge of the vertical portion of the rear component;

the leftwardly and inwardly oriented tab of the right side component container recess having a generally rectilinear configuration with an inner surface and an outer surface and a thickness therebetween;

the rightwardly and inwardly oriented tab of the left side component container recess having a generally rectilinear configuration with an inner surface and an outer surface and a thickness therebetween;

the vertical portion of the rear component of the container having a generally rectilinear configuration which a lower horizontal edge and an upper horizontal edge and a pair of vertical side edges being a right vertical side edge and a left vertical side edge;

the C bracket having a base portion and an intermediate portion and a top portion; and the horizontal upper edge of the angled portion of the rear component of the container having a generally upwardly directed tab extending from the horizontal upper edge of the angled portion of the rear component.

6. The charitable collection canister as described in claim 5, with the canister further comprising;

the front component of the container having a horizontal lower edge and a horizontal top edge, the horizontal lower edge of the front surface meeting with the horizontal front edge of bottom component;

the horizontal lower edge of the angled portion of the rear component of the container being angled relative to the upper horizontal edge of the vertical portion of the rear component; and the front component of the lid having an inwardly directed lip with the lip having three locking slot tabs, the locking slot tabs being configured to be received by and mated with the locking slots of the front portion of the bottom component.

7. The charitable collection canister as described in claim 6, with the canister further comprising;

the bottom component horizontal rear edge of the container intersecting with the rearwardmost extent of each of the horizontal bottom component side edges and the horizontal front edge of the bottom component of the container intersecting with each of the forwardmost extent of each of the horizontal bottom component side edges, the intersections thereby forming the four corners of the bottom component of the container; and the horizontal lower edge of the angled portion of the container being continuous with the upper horizontal edge of the vertical portion of the rear component of the container.

8. The charitable collection canister as described in claim 7, with the canister further comprising;

two parallelly located vertical front component side edges being a front component right vertical side edge and a front component left vertical side edge;

the side edges of the angled portion of the rear component of the container being located in an intersecting plane with the side edges of the vertical portion of the rear component thereby forming a side edge angle; and each of the locking slot tabs of the front component of the lid having a generally stepped configuration, the front component having a pair of parallelly oriented side edges being a right edge and a left edge.

9. The charitable collection canister as described in claim 8, with the canister further comprising;

the lower horizontal edge of the rear component of the container having a securement cable hole therethrough, with the securement cable hole having an associated securement cable running therethrough; and the side edge angle formed by the intersection of the side edges of the angled portion of the rear component of the container and the side edges of the vertical portion of the rear component of the container being an obtuse angle relative to the side edges of the vertical portion of the rear component.

10. The charitable collection canister as described in claim 9, with the canister further comprising;

right side component of the container having a truncated triangular configuration; and the inner surface of the top component of the lid having at least one adhesive strip coupled thereto.

11. The charitable collection canister as described in claim 10, with the canister further comprising;

the side edges of the rear component of the container being parallelly located;

the angle portion of the rear component of the container having a pair of parallelly located side edges; and the rear component of the lid side edges being parallelly oriented.

12. The charitable collection canister as described in claim 11, with the canister further comprising;

top component of the lid having a generally rectilinear configuration with the top component of the lid side edges being parallelly located;

the front component of the lid having a generally rectilinear configuration;

the rear component of the lid having a generally rectilinear configuration;

the right side component of the lid having a generally flat configuration;

the top edge of the right side component of the container having a recess therein with the recess having a lowermost extent;

the top edge of the left side component of the container having a recess therein with the recess having a lowermost extent; and the left side component of the lid having a generally flat configuration.

13. The charitable collection canister as described in claim 12, with the canister further comprising;

the container being fabricated of a rigid material;

the container bottom component side components being parallelly located;

the front component and the rear component of the container bottom component being parallelly located;

the bottom component of the container having a generally rectilinear configuration;

the front component of the container having a generally rectilinear configuration;

the left side component of the container having a truncated triangular configuration;

the angle portion of the rear component having a generally rectilinear configuration;

the forward edge of the left side component of the container and the rearward edge of the left side component of the container being parallelly located with the top edge of the left side component and the bottom edge of the left side component being located in intersecting planes;

the bottom component side edges being the bottom component right side edge and the bottom component left side edge being parallelly located;

the uppermost portion of the rear component having a generally rectilinear configuration;

the lid being fabricated of a rigid material;

the lid side components being parallelly located;

the front component and the rear component of the lid being located on intersecting planes; and the window panel being fabricated of a transparent material.

14. A charitable collection canister comprising, in combination:

a container having a bottom component and a pair of side components being a right side component and a left side component, and a front component and a rear component, the rear component having an uppermost portion with the uppermost portion having an upper horizontal edge, the upper horizontal edge having a money recess therein, the bottom component having an inner surface and an outer surface forming a thickness there between;

a light emitting diode being coupled to the bottom component;

at least one battery and a pair of wires electronically coupling the battery and the light emitting diode; and a lid having a top component and a pair of side components being a right side component and a left side component, and a front component and a rear component, the lid being removably coupled to the container, the top component of the lid having an having a money slot, with the money slot having an inwardly and rearwardly oriented tab, the lid being removably coupled with the container.

15. The charitable collection canister as described in claim 14, with the canister further comprising;

the lid top component having a window aperture therethrough;

a window panel, the window panel being coupled to the top component of the lid;

the container bottom component having at least one locking slot therethrough;

the lid having at least one locking tab coupled thereto, the locking tab being configured to be mated with and received by the locking slot;

a C shaped bracket coupling the light emitting diode to the bottom component; and the container bottom component having at least one foot pad aperture therethrough, the bottom component having at least one locking slot there through.

16. A charitable collection canister comprising, in combination:

a container having at least one locking slot, the container having an inner surface;

a light emitting diode being coupled to the inner surface of the container;

at least one battery and a pair of wired coupling the light emitting diode to the battery;

a lid having at least one locking tab, the locking tab being configured to be mated with and received by the locking slot of the container, allowing the lid to be removably coupled to the container;

the container having a baffle plate, the container having at least one foot pad aperture with the foot pad aperture having a foot pad coupled thereto, the container having at least one lock hole therethrough;

the lid having a window aperture therethrough;

a window panel, the window panel being coupled to the lid; and the light emitting diode being visible through the window panel, with the light emitting diode being illuminated.

* * * * *